US005269084A

United States Patent [19]

Best et al.

[11] Patent Number: 5,269,084

[45] Date of Patent: Dec. 14, 1993

[54] PHOTOGRAPHIC GREETING CARD

[75] Inventors: Scott D. Best, Troy; James F. Turner, Farmington Hills, both of Mich.

[73] Assignee: Saxon Incorporated, Ferndale, Mich.

[21] Appl. No.: 910,199

[22] Filed: Jul. 7, 1992

[51] Int. Cl.[5] ..... B44C 5/00

[52] U.S. Cl. ..... 40/158.1; 40/152.1; 40/124.1

[58] Field of Search ..... 40/152.1, 124.1, 158.1

[56] References Cited

U.S. PATENT DOCUMENTS

| | | | |
|---|---|---|---|
| 4,662,093 | 5/1987 | Suttles et al. | 40/158.1 |
| 4,825,574 | 5/1989 | George | 40/158.1 |
| 4,947,566 | 8/1990 | Hoebel | 40/158.1 |
| 4,953,780 | 9/1990 | Ross | 40/158.1 |
| 5,201,133 | 4/1993 | Best et al. | 40/158.1 |

*Primary Examiner*—Peter R. Brown
*Assistant Examiner*—C. Hope Davis
*Attorney, Agent, or Firm*—Reising, Ethington, Barnard, Perry & Milton

[57] ABSTRACT

A photographic greeting card (20) for displaying a photograph (22) including a frame sheet (32) and a greeting card sheet (34). The frame sheet (32) includes a border section (48) with a center section (56) which is surrounded by the border section (48). The center section (56) is removable from the border section (40) such that an adhesive (54) is exposed on an inside surface (40) of the border section (48) for holding a margin (28) of the photograph (22). A fold line including a plurality of spaced die cuts (72) and a plurality of interspaced uncut segments (76) interconnect the frame sheet (32) and the card sheet (34) for folding the frame sheet (32) relative to the card sheet (34) and for separating the frame sheet (32) from the card sheet (34). Finally, the greeting card sheet (34) and the frame sheet (32) can form a frame into which the photograph (22) is permanently sealed. To prevent misalignment of the two halves of the frame during folding and sealing an adhesive alignment strip (86) is provided.

27 Claims, 6 Drawing Sheets

PHOTOGRAPHIC GREETING CARD

TECHNICAL FIELD

The present invention relates to support, mounting and display media for visual displays such as photographs and includes inexpensive frames of paper and polymeric materials for use with photographs and the like.

BACKGROUND OF THE INVENTION

Greeting cards which include photographs are well known in the art. U.S. Pat. Nos. 2,878,607 and 4,033,061 are illustrative examples. However, these cards are generally produced from several layers thereby increasing fabrication expense. This increases the costs to such a degree that it becomes impractical to include the greeting card in packages of developed prints as an inducement to use a particular film developer's service. Further, the cards are relatively complex to assemble. Finally, the photographs cannot be displayed, or placed in an album, without the greeting card which would not be appropriate once the occasion or holiday commemorated by the card has passed.

In addition, there can be alignment problems when permanently sealing a photograph in a frame utilizing adhesives. In addition to properly aligning the photograph in the viewing area there can be a problem in lining up the two halves of the frame. Even when the two halves are connected, or hinged as in a folder-like frame, the folding may not lead to a perfect alignment giving a ragged appearance which cannot be corrected because of the adhesive sealing.

SUMMARY OF THE INVENTION AND ADVANTAGES

The present invention is a photographic greeting card for displaying a photograph including a frame sheet which has an outside surface and an inside surface opposite the outside surface. The photographic greeting card further includes a greeting card sheet having an outside surface and an inside surface opposite the outside surface. The frame sheet and the card sheet inside surfaces are contiguous and the outside surfaces are also contiguous. The frame sheet further includes a border section which defines a center section; that is, the center section is surrounded by the border section. An adhesive is disposed on the inside surface with a single removable liner covering the adhesive. The liner includes a middle portion larger than the center section which defines an inner margin on the inside surface. The frame sheet includes release means for allowing removal of both the center section from within the border section and the middle portion of the liner to expose a border adhesive on the inside surface of the inner margin of the border section for holding a margin of the photograph. The photographic greeting card is characterized by fold means interconnecting the frame sheet and the card sheet for folding the frame sheet relative to the card sheet and for separating the frame sheet from the card sheet.

The present invention provides a greeting card frame for the display of photographs which is formed in one sheet and is therefore inexpensive to produce. The greeting card frame further allows for simple assembly by providing a viewing area in which to position the photograph using an adhesive, no folding of various layers is required to position the photograph for viewing. Further the greeting card sheet can be easily separated from the frame sheet to allow permanent display of the photograph without the greeting card sheet. Finally, the greeting card sheet and frame sheet can form a frame into which the photograph is permanently sealed. To prevent misalignment of the two halves of the frame during folding and sealing an adhesive alignment strip is provided.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
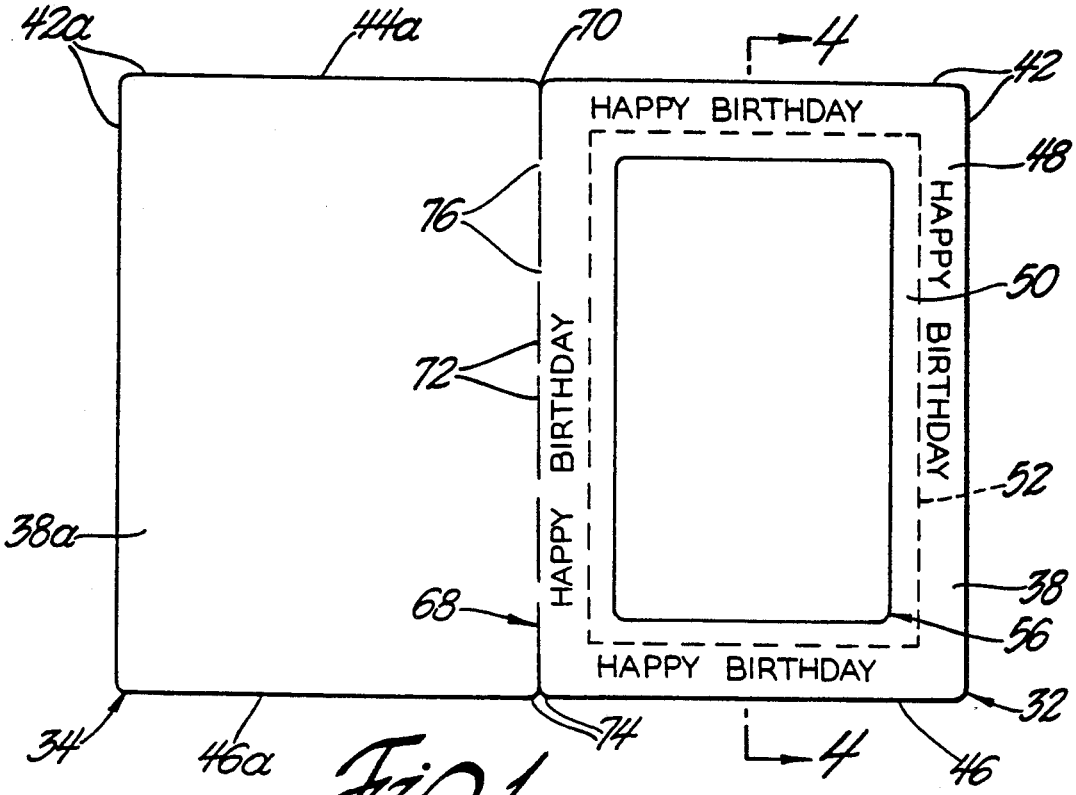
FIG. 1 is a front view of a photographic greeting card according to the instant invention prior to assembly.

Referring to FIGS. 1–8, wherein like numerals indicate like or corresponding parts throughout the several views, a photographic greeting card constructed in accordance with the instant invention is generally shown at 20. The photographic greeting card 20 surrounds and supports a photograph generally shown at 22. The photograph 22 includes a pictorial face 24 and a rear surface 26 opposite the pictorial face 24. The pictorial face 24 includes a margin 28 surrounding a central viewing area 30. The margin 28 may be defined by a border distinct from the pictorial face 24, or simply by the peripheral edges of the photograph 22.

Figure 2:
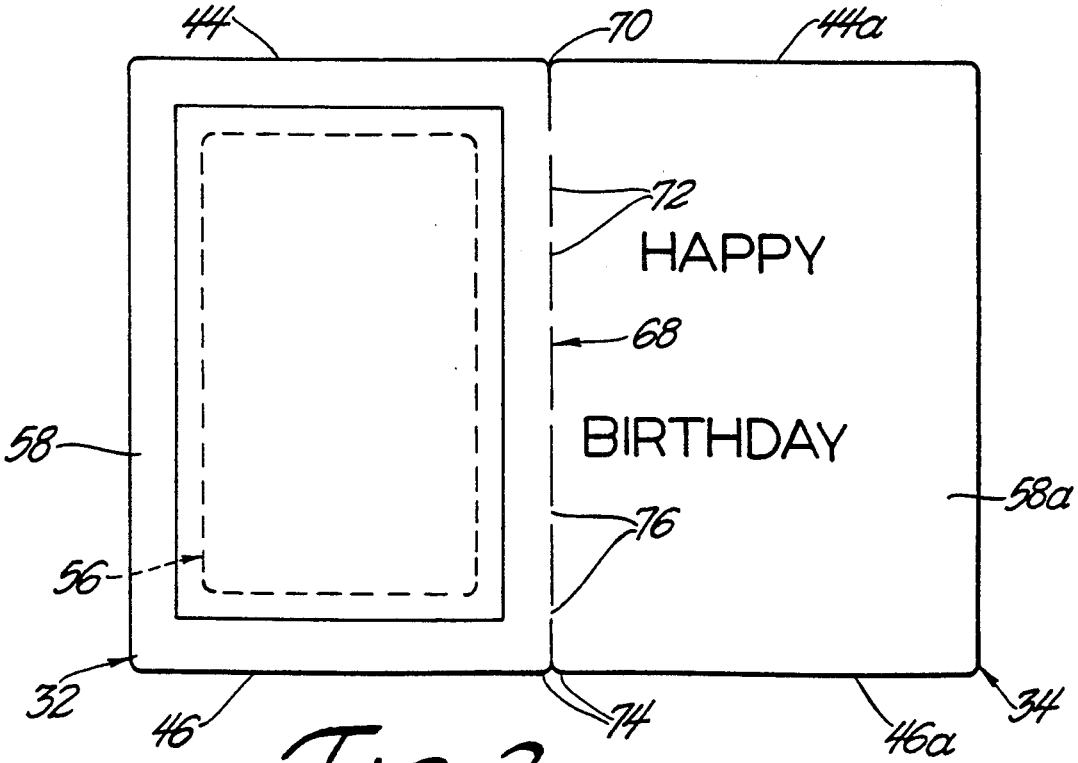
FIG. 2 is a rear view of a photographic greeting card according to the instant invention prior to assembly.

The photographic greeting card 20 includes a frame sheet, generally indicated at 32, and a greeting card sheet, generally indicated at 34, fabricated from a cellulose fiber material. The frame sheet 32 has an outside surface 38 with an inside surface 40 opposite the outside surface 38. The greeting card sheet 32 has an outside surface 38*a* with an inside surface 40*a* opposite the outside surface 38*a*. The frame sheet 32 and the card sheet 34 inside surfaces 40,40*a* are contiguous and the outside surfaces 38,38*a* are also contiguous, as best shown in FIGS. 1 and 2.

The frame sheet 32 has an outer edge 42 which includes a top edge 44 and a bottom edge 46. The card sheet 34 also has an outer edge 42*a* which includes a top edge 44*a* and a bottom edge 46*a*. The top edge 44 of the frame sheet 32 is co-extensive with the top edge 44*a* of the card sheet 34. The bottom edge 46 of the frame sheet 32 is co-extensive with the bottom edge 46*a* of the card sheet 34.

Figure 9:
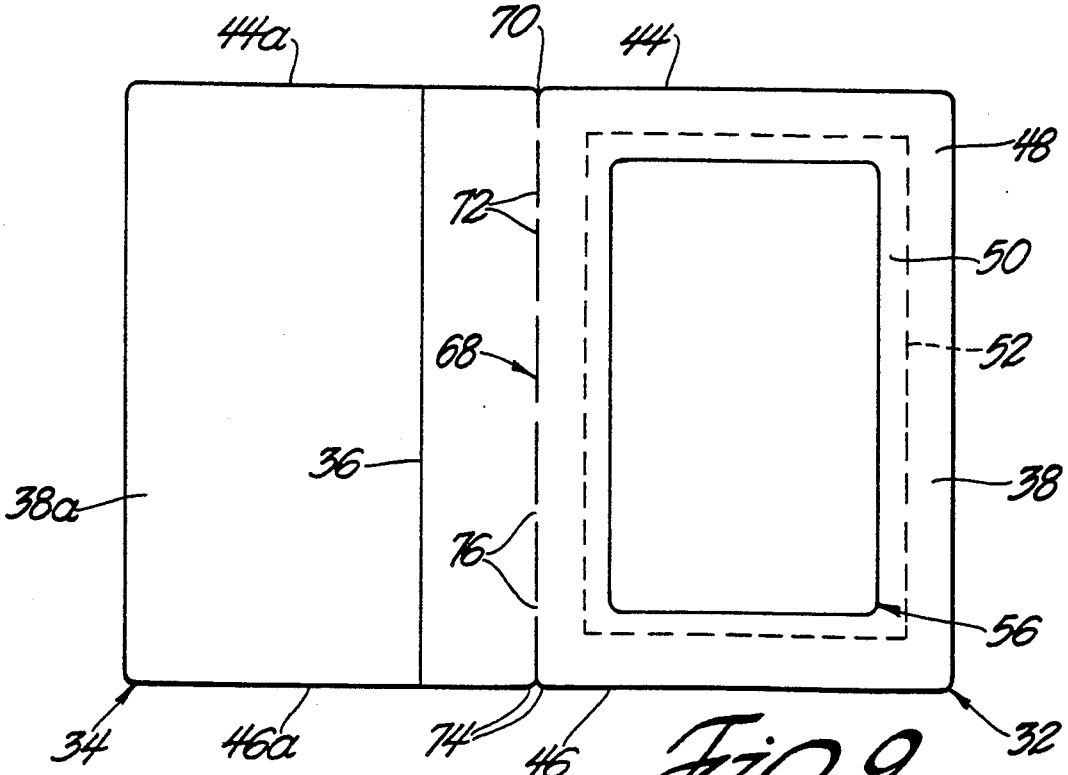
FIG. 9 is a front view of a photographic greeting card according to the instant invention prior to sealing.
Figure 10:
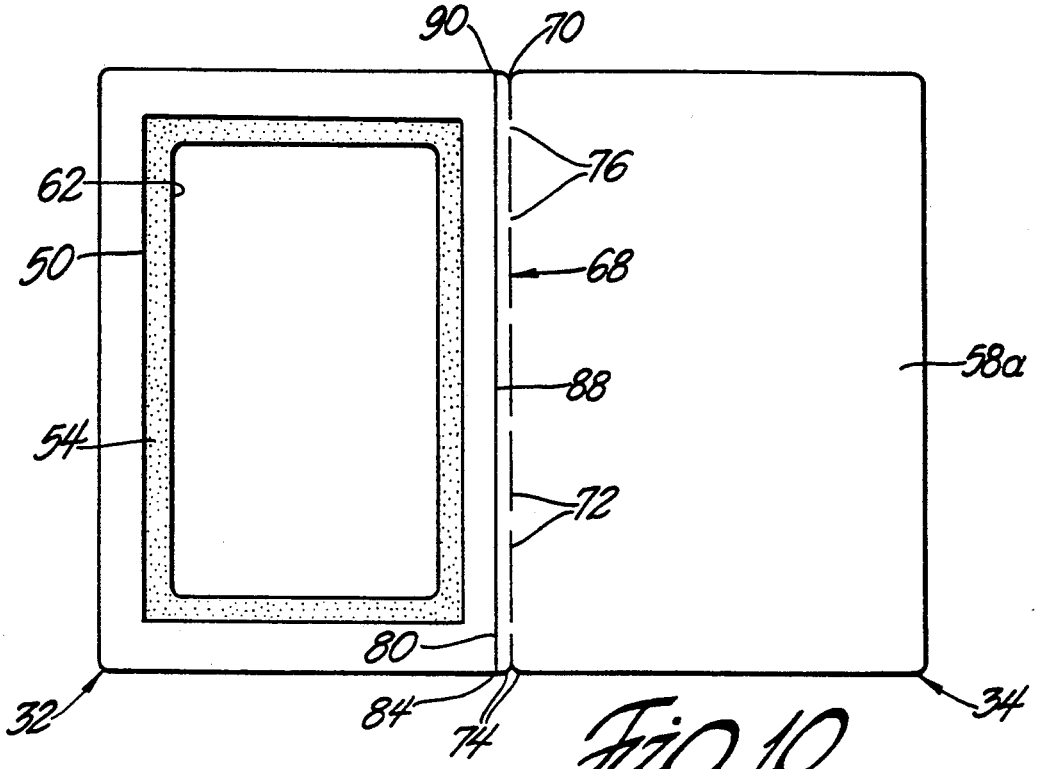
FIG. 10 is a rear view of a photographic greeting card as in FIG. 9 of the instant invention prior to sealing showing an exposed adhesive layer forming an inner margin for mounting a photograph.

The frame sheet 32 and greeting card sheet 34 are fabricated from 130 pound tag stock with a 60 pound machine finished liner. An adhesive 47 is disposed on the inside surface 40 of the frame sheet 32 and the inside surface 40*a* of the card sheet 34. The outside surface 38 of the frame sheet 32 is overlaminated with polypropylene laminate. At least part of the outside surface 38*a* of the card sheet 34 is overlaminated with polypropylene laminate. Partial lamination 36, as shown in FIG. 9, allows for writing on the outside surface 38*a* of the card sheet 34.

Figure 3:
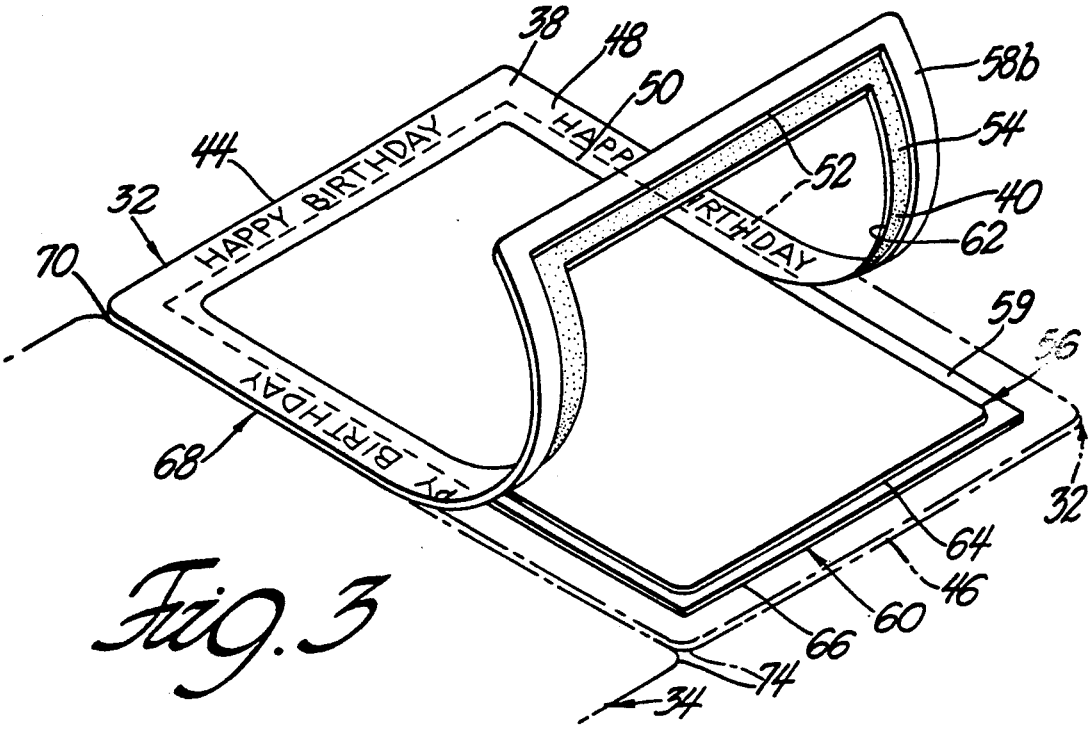
FIG. 3 is a perspective view of a photographic greeting card according to the instant invention with the front layer partially peeled back.
Figure 7:
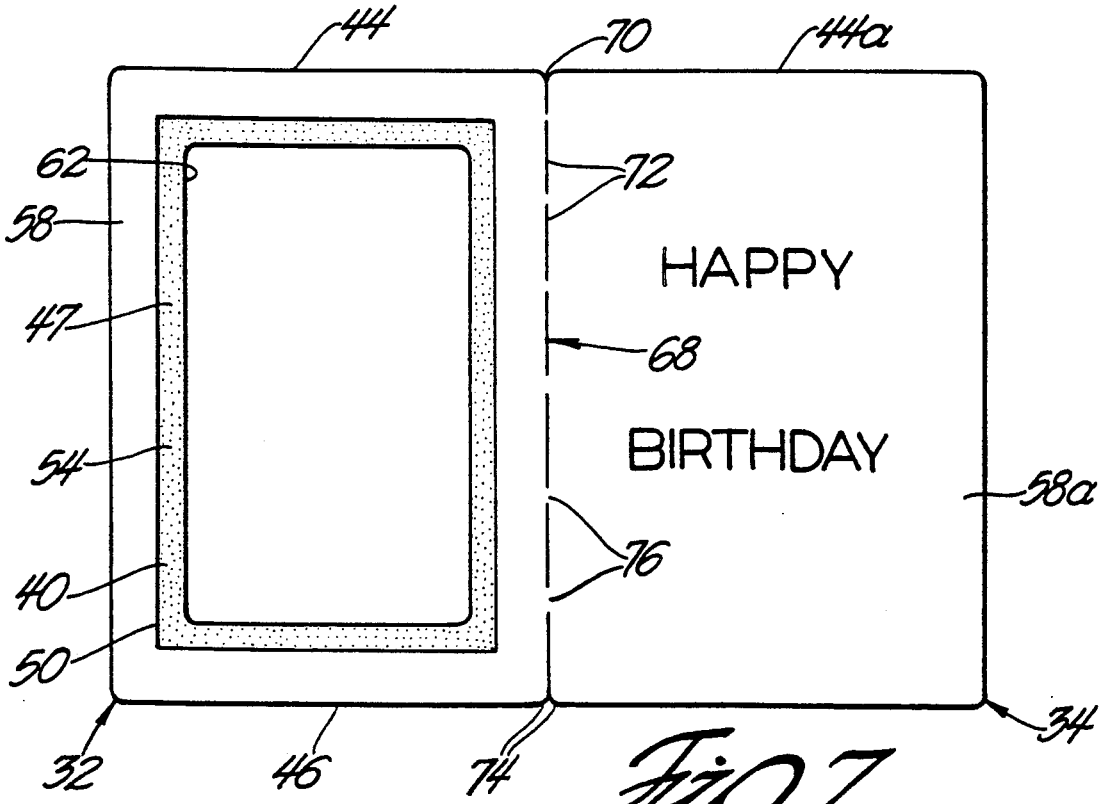
FIG. 7 is a rear view taken substantially along line 7—7 of FIG. 5 showing an adhesive layer exposed which forms an inner margin.
Figure 8:
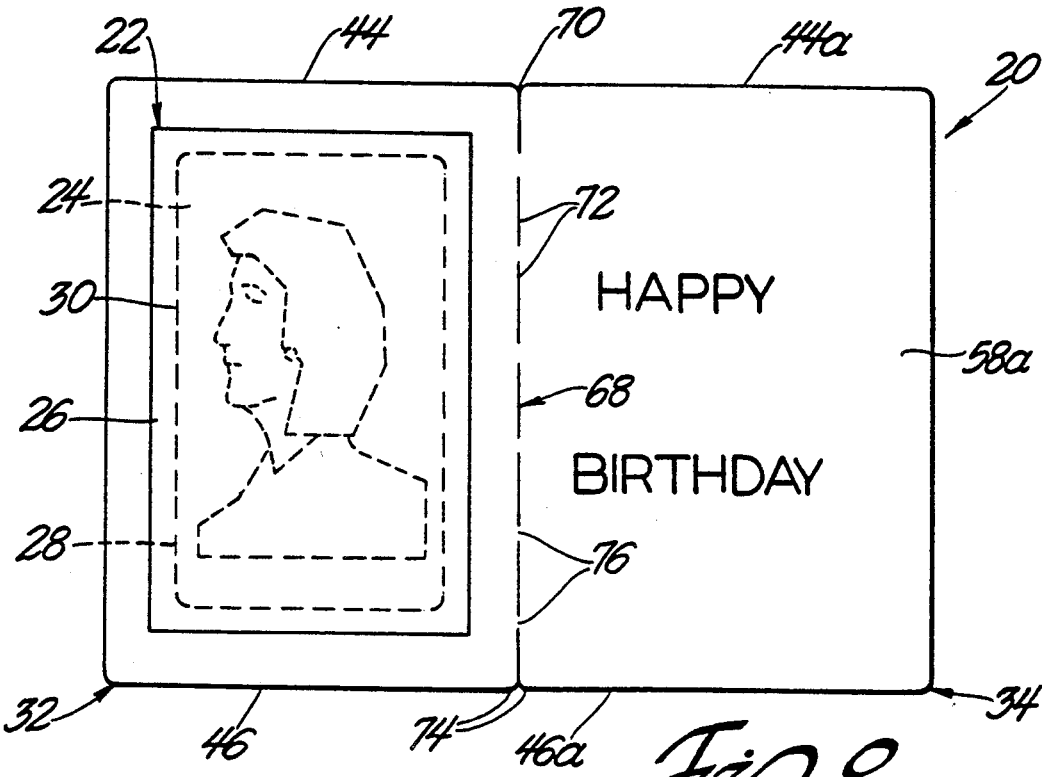
FIG. 8 is a rear view of a photographic greeting card according to the instant invention after assembly.

The frame sheet 32 further includes a border section 48 extending completely around the frame sheet 32. The border section 48 includes an inner margin 50. The border section 48 extends inwardly from the outer edge 42 of the frame sheet 32 through the inner margin 50. The inner margin 50 has an outer perimeter 52 that generally delineates the boundary of the inner margin 50 within the border section 48. A border adhesive 54 is disposed on the inside surface 40 of the border section 48 as best shown in FIGS. 3 and 7 and is coextensive with the adhesive 47 on disposed on the inside surface 40 of the frame sheet 32. The adhesive used in the preferred embodiment is a special release permanent AT-1 adhesive with the 60 pound machine finish liner. The border section 48 could have a color such that the border section 48 presents a colored appearance. The border section 48 could also have a greeting inscribed on it.

Figure 6:
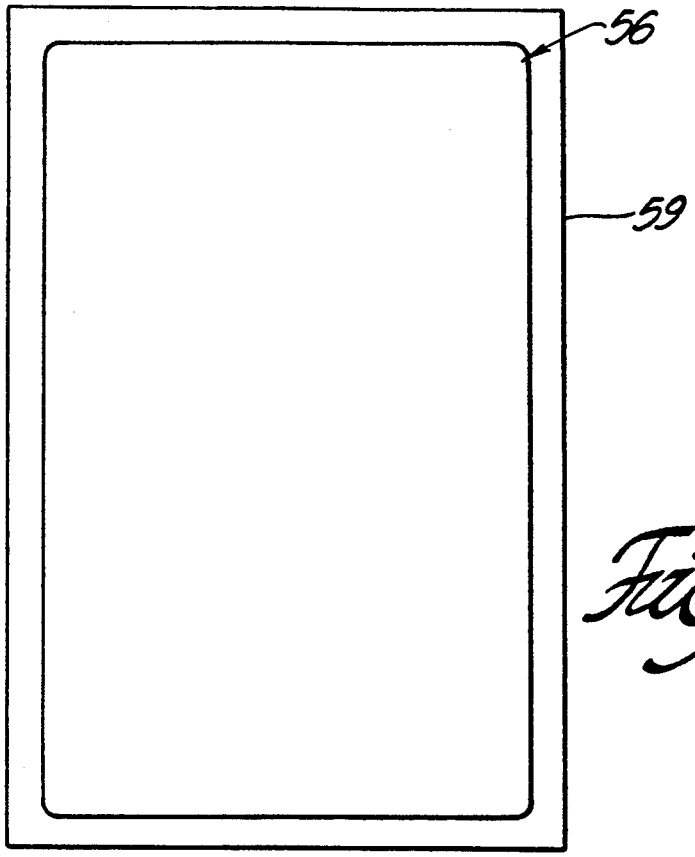
FIG. 6 is a front view taken substantially along line 6—6 of FIG. 5.

The frame sheet 32 includes a center section, generally indicated at 56, that is disposed within the border section 48 and is defined by the border section 48 as is best shown in FIGS. 3 and 6. In other words, the center section 56 is surrounded by the border section 48.

Figure 5:
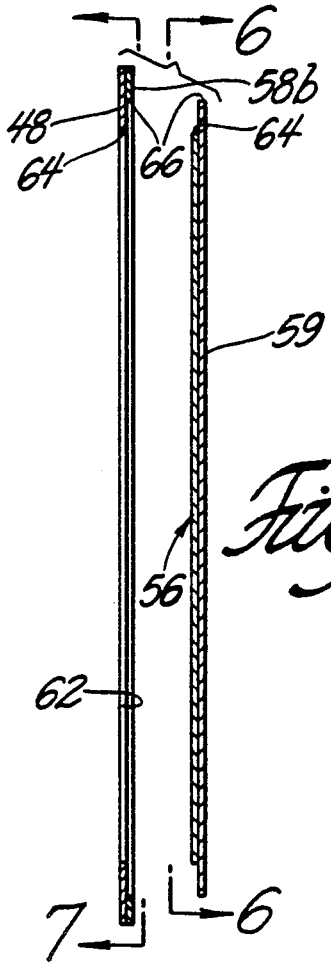
FIG. 5 is a cross-sectional view as in FIG. 4 showing the border section and a portion of the backing sheet exploded from the center section and the remainder of the backing sheet.

A single removable liner 58 is disposed on the border adhesive 54 and center section 56. The liner 58 covers the entire inside surface 40 of the frame sheet 32 and adhesive 47 and is best shown in FIGS. 3, 5 and 6. Further, a liner 58*a* covers the adhesive 47 disposed on the entire inside surface 40*a* of the card sheet 34. A greeting can be inscribed on the liner 58*a* of the greeting card sheet 34. The liners 58,58*a* covering the card 34 and frame 32 sheet are coextensive.

Release means, generally indicated at 60, is provided for removing the center section 56 from within the border section 48. That is, the center section 56 can be removed from the frame sheet 32 due to the release means 60. When the center section 56 is removed from the frame sheet 32, an empty viewing region 62 is formed surrounded by the border section 48 as best shown in FIGS. 5 and 7. The viewing region 62 corresponds in size to the central viewing area 30 of the photograph 22.

Figure 4:
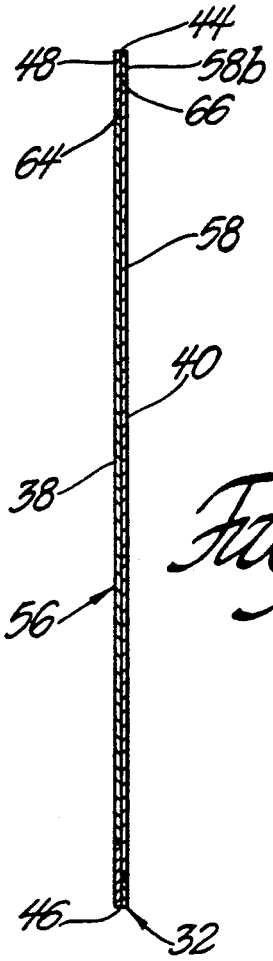
FIG. 4 is a cross-sectional view taken substantially along line 4—4 of FIG. 1.

The release means 60 includes a first die cut 64 between the center section 56 and the border section 48 from the outside surface 38 to the inside surface 40 that is, up to but not through the removable liner 58 as best shown in FIGS. 3 and 4. In other words the first die cut 64 extends through the frame sheet 32, but not the liner 58. The first die cut 64 is made at the boundary between the center section 56 and the border section 48. The release means 60 further includes a second die cut 66 through the removable liner 58 along the outer perimeter 52 of the inner margin 50 defining a middle portion 59 of the removable liner 58 larger than the center section 56 as best shown in FIGS. 3, 5 and 6. The second die cut 66 does not go through the frame sheet 32 as best shown in FIGS. 3 and 4. The first 64 and second 66 die cuts are spaced from each other, such that they define the inner margin 50 on the inside surface 40 of the border section 48.

The release means 60 additionally provides for removing the center section 56 with the middle portion 59 of the liner 58 still attached as best shown in FIGS. 5 and 6. The middle portion 59 extends beyond the center section 56 and first die cut 64 only to the second die cut 66. Therefore removal of the center section 56 with the middle portion 59 of the liner 58 attached exposes the border adhesive 54 on the inside surface 40 of the inner margin 50. A remainder of the backing sheet 58*b*, from the second die cut 66 to the outer edge 42, remains on the inside surface 40 of the border section 48 thereby not exposing the rest of the border adhesive 54 as best shown in FIGS. 3, 4 and 5. The remainder 58*b* forms a guide into which to place the photograph 22 and orientate the photograph 22 such that the central viewing area 30 of the photograph 22 is aligned with the viewing region 62 of the frame sheet 32.

When the photograph 22 is disposed on the frame sheet 32, the border section 48 of the frame sheet 32 overlaps the margin 28 on the pictorial face 24 of the photograph 22 thereby surrounding the central viewing area 30 of the photograph 22. The central viewing area 30 is visible in the viewing region 62 of the frame sheet 32.

In an alternative embodiment, not shown, there is no second die cut 66, such that when the center section 56 is removed the entire liner 58 is removed. This allows the exposure of all of the border adhesive 54 such that a larger area of adhesive 47 is available to bind to the photograph 22.

The frame sheet 32 and the card sheet 34 are interconnected by fold means, generally indicated at 68. The fold means 68 allow for separating the frame sheet 32 from the card sheet 34 to allow permanent display of the photograph 22 without the greeting card sheet 34.

The fold means 68 includes a fold line 70 extending perpendicularly between the top edge 44,44*a* and the bottom edge 46,46*a* and that is disposed between the frame sheet 32 and the card sheet 34. The fold means 68 also includes a plurality of spaced die cuts 72 disposed along the fold line 70. The spaced die cuts 72 extend through the card 34 and frame 32 sheets including the liner 58,58*a*. A spaced die cut 72 is found where the fold line intersects either the top 44,44*a* or bottom 46,46*a* edges. A pair of rounded corners 74 extends from the top 44,44*a* and bottom 46,46*a* edges into the fold line 70 spaced die cuts 72. The fold means 68 further includes a plurality of uncut segments 76 disposed on the fold line 70 interspaced between the spaced die cuts 72. In other words, the spaced die cuts 72 alternate with the uncut segments 76 along the fold line 70. These uncut segments 76 define a plurality of hinge-like sections across the fold line 70 which interconnect the card 34 and frame 32 sheets and the liners 58,58*a* disposed on the inside surfaces 40,40*a*. The hinge-like sections allow the card 34 and frame 32 sheets to fold relative to one another easily, as in a greeting card. The spaced die cuts 72 allow for ease of separation of the frame sheet 32 from the card sheet 34.

Further, the fold means 68 allow for folding the frame sheet 32 relative to the card sheet 34 such that an enclosing frame is formed into which the photograph 22 can be permanently sealed. To do so strip means, generally indicated at 78 and best shown in FIGS. 8–13, which include a fold die cut 80 are provided such that the inside surface 40*a* of the card sheet 34 may be sealed to the inside surface 40 of the frame sheet 32. The fold die cut 80 is disposed on the inside surface 40 of the frame sheet 32 and spaced from the fold line 70 and extends perpendicularly between the top edge 44 and the bottom edge 46 of the frame sheet 32. The fold die cut 80 extends through the removable liner 58.

The fold line 70 and fold die cut 80 delineate a fold strip 84. A fold strip adhesive 86, which is coextensive with adhesive 47, is disposed on the fold strip 84 and is covered by a strip portion 88 of the liner 58. Therefore to seal the frame 32 and card 34 sheet together the fold strip adhesive 86 and adhesive 47 disposed on the card sheet 34 inside surface 40*a* are exposed. The inside surfaces 40,40*a* of the frame 32 and card 34 sheets are brought together such that the fold strip adhesive 86 bonds first with the card adhesive 47. This facilitates accurate folding since the card sheet 34 does not get out of alignment during the folding process because the initial bonding of the two adhesive layers holds the frame 32 and card 34 sheet in alignment. When sealed the outer edges 42,42*a* of the card 34 and frame 32 sheets will be aligned.

In the method of fabricating a photographic greeting card 20, a frame sheet 32 including a border section 48 surrounding a center section 56 and a greeting card sheet 34 are fabricated from cellulose fiber. A contiguous inside surface 40,40*a* of the frame 32 and card 34 sheet are covered with an adhesive 47. A coextensive removable backing sheet 58,58*a* is placed over the adhesive 47 disposed on the inside surface 40,40*a* of the frame 32 and card 34 sheets. Die cuts are made to allow removal of the center section 56 from the frame sheet 32 along the boundary of the border section 48 with the center section 56. Further die cuts are made to allow removal of a middle portion 59 of the removable backing sheet 58 along with the center section thereby exposing an inner margin 50 on the inside surface 40 of the border section 48.

A fold line is formed between the frame sheet 32 and the card sheet 34 to allow card-like folding, or to allow the removal of the card sheet 34 from the frame 32 or to allow the forming of an enclosing frame in which to seal a photograph 22. The fold line 70 is formed extending perpendicularly between a top edge 44,44*a* and a bottom edge 46,46*a* of the frame 32 and card 34 sheets. Further die cutting forms spaced die cuts 72 that are made along the fold line 70 interspaced with uncut segments 76. This forms a plurality of hinge sections extending across the fold line 70 to interconnect the card 34 and frame 32 sheets. A fold die cut 80 is made on the inside surface 40 of the frame sheet 32 and is spaced from the fold line 70 and extends perpendicularly between the top edge 44 and the bottom edge 46 of the frame sheet 32 thereby defining a fold strip 84. The fold die cut 80 extends through the removable liner 58.

In the method of assembly, the center section 56 is removed from the frame sheet 32 with the middle portion 59 of the removable backing sheet 58 in place and thereby only exposing the border adhesive 54 disposed on the inner margin 50. The removal of the center section 56 from within the border section 48 forms a viewing region 62 within the border section 48. A photograph pictorial face 24 is positioned adjacent to the inside surface 40 of the border section 48 with a central viewing area 30 of the photograph 22 Visible in the viewing region 62. A margin 28 surrounding the central viewing area 30 of the photograph 22 is secured to the border adhesive 54 disposed on the inside surface 40 of the border section 48.

In the method of separating the card sheet 34 from the frame sheet 32 along the fold line 70, the uncut segments 76 are divided. The start of the separation is facilitated by the spaced die cut 71 that is placed at the intersection of the fold line 70 and the top edge 44,44*a*. The separation starts at that point and is then directed down the fold line 70 through the spaced die cuts. At each interspaced uncut segment 76 the force exerted divides the uncut segment 76 to continue the separation until complete.

Figure 11:
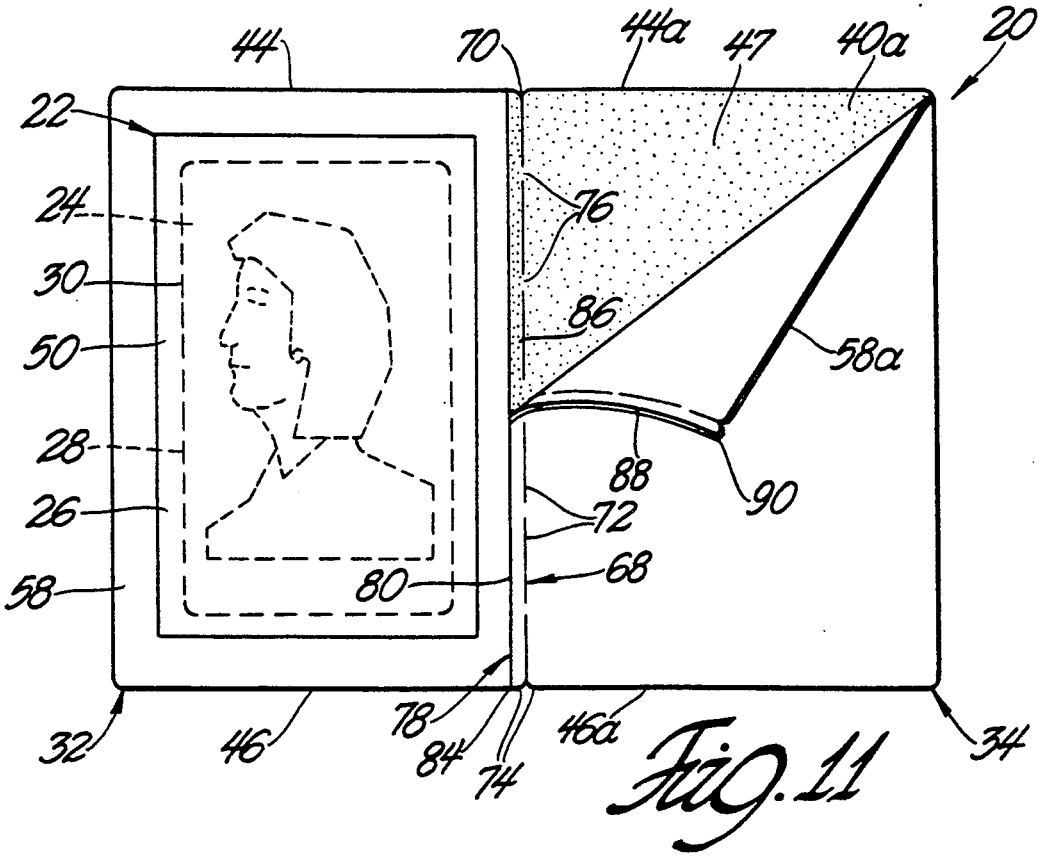
FIG. 11 is a perspective view of a photographic greeting card as in FIG. 10 according to the instant invention with the liner partially peeled back showing an exposed adhesive layer for sealing.
Figure 12:
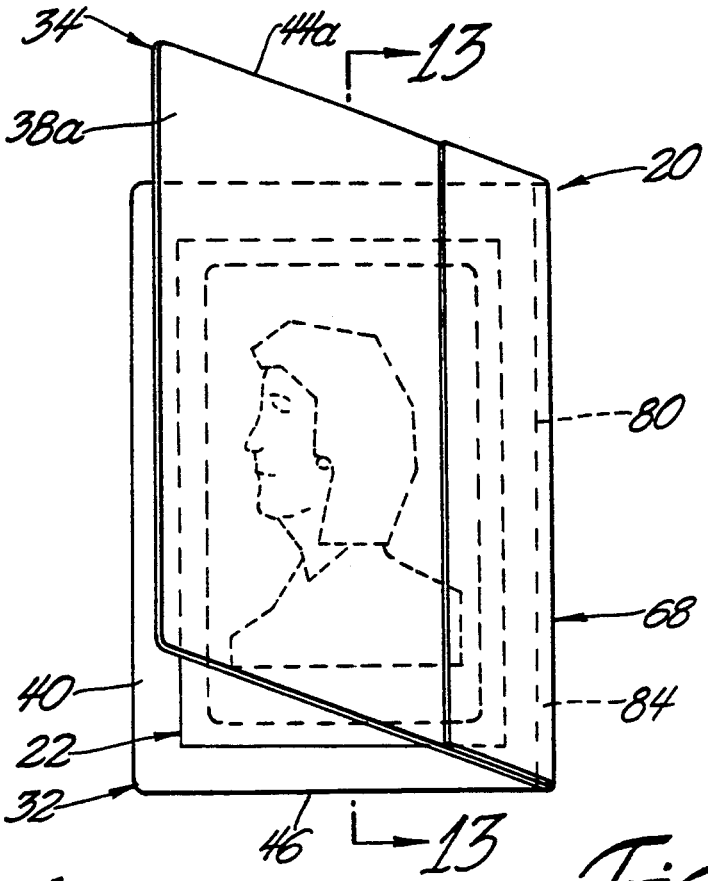
FIG. 12 is a perspective view of a photographic greeting card as in FIG. 10 according to the instant invention with a card sheet partially folded onto the frame sheet prior to sealing.
Figure 13:
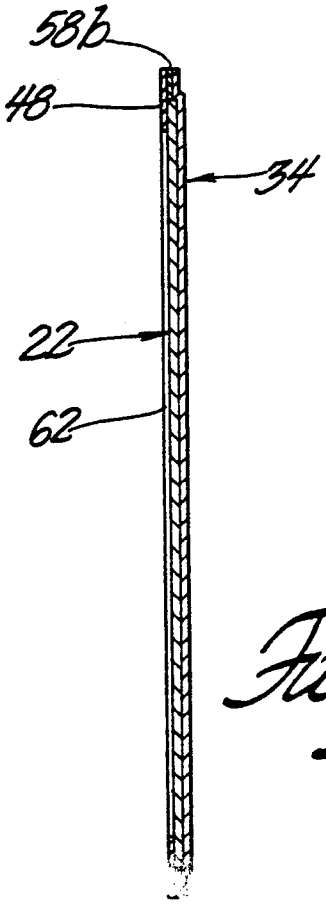
FIG. 13 is a cross-sectional view taken substantially along line 13—13 of FIG. 12 after sealing.

In the method to seal the inside surface 40*a* of the card sheet 34 to the inside surface 40 of the frame sheet 32 thereby to permanently frame the photograph 22, the strip portion 88 of the liner 58 disposed on the fold strip 84 is removed thereby exposing the fold strip adhesive 86. Further the removable liner 58*a* is removed from the card sheet 34 thereby exposing the adhesive 47 disposed on the inside surface 40*a* of the card sheet 34. To remove the liners 58*a*,88 a corner 90 of the strip portion 88 formed at the point where the fold die cut 80 intersects the top edge 44 is lifted and with a continuous motion the strip portion 88 and liner 58*a* covering the card sheet 34 is peeled back and off as best shown in FIG. 11. Since the strip portion 88 and card liner 58*a* are interconnected by the uncut segments formed during the die cutting of the fold line 70 it is possible to remove the liners in one piece. Once the adhesive is exposed the card sheet 34 is folded relative to the frame sheet 32 at the fold line 70. The exposed fold strip adhesive 86 bonds first with the card adhesive 47 which facilitates accurate sealing as best shown in FIGS. 12 and 13. The two adhesive surfaces 47,86 hold the frame 32 and card 34 sheets of the photographic greeting card 20 in proper alignment during the folding process thereby ensuring that the frame 32 and card 34 outer edges 42,42*a* line up evenly when they are sealed together.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A photographic greeting card article (20) comprising:

a frame sheet (32) having an outside surface (38) and an inside surface (40) opposite said outside surface (38), a greeting card sheet (34) having an outside surface (38a) and an inside surface (40a) opposite said outside surface (38a), said frame sheet (32) and said card sheet (34) inside surfaces (40,40a) being contiguous and said outside surfaces (38,38a) being contiguous, said frame sheet (32) including a peripheral border section (48) to define a center section (56), an adhesive (47) disposed on said inside surface (40,40a) of both said frame (32) and card (34) sheets, a single removable liner (58,58a) covering said adhesive (47) including a middle portion (59) larger than said center section (56), said middle portion covering said center section to define an inner margin (50) on said inside, surface (40) of said frame sheet (32), release means (60) for allowing removal of both said center section (56) from within said border section (48) and said middle portion (59) to expose a border adhesive (54) on said inside surface (40) of said frame section (48) for holding a margin (28) of a photograph (22), characterized by fold means (68) interconnecting said frame sheet (32) and said card sheet (34) for folding said frame sheet (32) relative to said card sheet (34) and for separating said frame sheet (32) from said card sheet (34).

2. An article as set forth in claim 1 wherein said frame (32) and said card (34) sheets include a coextending top edge (44,44a) and a coextending bottom edge (46,46a), further characterized by said fold means (68) including a fold line (70) extending perpendicularly between said top edge (44,44a) and said bottom edge (46,46a) between said frame sheet (32) and said card sheet (34).

3. An article as set forth in claim 2 further characterized by said fold means (68) including spaced die cuts (72) extending through said card (34) and frame (32) sheets along said fold line (70).

4. An article as set forth in claim 3 further characterized by said fold means (68) including a plurality of uncut segments (76) disposed on said fold line (70) between said spaced die cuts (72) to define a plurality of hinge sections thereacross, said fold line (70) interconnecting said card (34) and frame (32) sheets.

5. An article as set forth in claim 4 further characterized by a fold die cut (80) extending through said removable liner (58) disposed on said inside surface (40) of said frame sheet (32) and spaced from said fold line (70) and extending perpendicularly between said top edge (44) and said bottom edge (46).

6. An article as set forth in claim 5 further characterized by rounded corners (74) extending from said top (44,44a) and bottom (46,46a) edges into said fold line (70).

7. An article as set forth in claim 5 further characterized by said release means (60) including a first die cut (64) between said center section (56) and said border section (48) extending from said outside surface (38) to said inside surface (40).

8. An article as set forth in claim 7 further characterized by said release means (60) including a second die cut (66) through said removable liner (58) along an outer perimeter (52) of said inner margin (50).

9. An article as set forth in claim 8 further characterized by said inner margin (50) of an border section (48) adapted to overlapping the margin (28) of the photograph (22).

10. An article as set forth in claim 9 further characterized by said frame (32) and card (34) sheets fabricated from cellulose fiber and said outside surface (38) of said frame sheet (32) and at least part of said outside surface (38a) of said card sheet (34) overlaminated with a polypropylene laminate.

11. An assembly as set forth in claim 10 further characterized by said border section (48) having a color.

12. A frame sheet article (20) for displaying a photograph (22), said article comprising:

a frame sheet (32) having an outside surface (38) and an inside surface (40) opposite said inside surface (38), a card sheet (34) having an outside surface (38a) and an inside surface (40a) opposite said inside surface (38a), said frame sheet (32) including a peripheral border section (48) to define a center section (56), an adhesive (47) disposed on said inside surface (40), a single removable liner (58) covering said adhesive (47) including a middle portion (59) larger than said center section (56) to define an inner margin (50) on said inside surface (40), release means (60) for allowing removal of both said center section (56) from within said border section (48) and said middle portion (59) to expose a border adhesive (54) on said inside surface (40) of said frame border section (48) for holding a margin (28) of the photograph (22), and characterized by strip means (78) located on said inside surface of the frame sheet for sealing said inside surface (40a) of said card sheet (34) to said inside surface (40a) of said frame sheet (32) to permanently frame the photograph (22).

13. An article as set forth in claim 12 wherein said frame (32) and said card (34) sheets include a coextending top edge (44,44a) and a coextending bottom edge (46,46a), further characterized by said strip means (78) includes a fold die cut (80) disposed on said inside surface (40) of frame sheet (32) and spaced from a said fold line (70) located between said frame sheet and said card sheet and extending perpendicularly between said top edge (44) and said bottom edge (46).

14. An article as set forth in claim 13 further characterized by said fold die cut (80) extending through said removable liner (58).

15. A method of fabricating a photograph greeting card assembly (20) comprising the steps of:

providing a card sheet and a frame sheet (32) with said card sheet (34) interconnected to said frame sheet at a fold line (70), removing a center section (56) from within a peripheral border section (48) of the frame sheet (32) to form a central viewing region (62) within the border section (48), positioning a photograph (22) adjacent to an inside surface (40) of the border section (48) and over the viewing region (62), securing a margin (28) of the photograph (22) to the inside surface (40) of the border section (48), separating the card sheet (34) from the frame sheet, (32) to allow separate display of the photograph (22) without the card sheet (34).

16. A method as set forth in claim 15 further characterized by forming a plurality of hinge sections thereacross said fold line (70).

17. A method as set forth in claim 16 further characterized by making spaced die cuts (72) along the fold line (70) to allow removal of the card sheet (34) from the frame sheet (32).

18. A method as set forth in claim 17 further characterized by covering the inside surface (40,40*a*) with adhesive (47).

19. A method as set forth in claim 18 further characterized by placing a single removable liner (58) over the adhesive (47) disposed on the inside surfaces (40,40*a*).

20. A method as set forth in claim 19 further characterized by die cutting to allow removal of the center section (56) from within the border section (48) of the frame sheet (32).

21. A method as set forth in claim 20 further characterized by die cutting to allow removal of a middle portion (59) of the removable liner (58) larger than the center section (56) thereby forming an inner margin (50) on the inside surface (40) of the border section (48).

22. A method as set forth in claim 21 further characterized by simultaneously the center section (56) from the frame sheet (32) with the middle portion (59) of the removable liner (58) thereby only exposing the adhesive (54) disposed on the inner margin (50).

23. A method as set forth in claim 22 further characterized by die cutting, through the removable liner (58) to form a fold die cut (80) disposed on the inside surface (50) of the frame sheet (32) and spaced from the fold line (70) thereby defining a fold strip (84) disposed on the frame sheet (32) with a strip portion of removable liner (88).

24. A method as set forth in claim 23 further characterized by removing the strip portion of removable liner (88) disposed on the fold strip (84) thereby exposing a fold strip adhesive (86).

25. A method as set forth in claim 24 further characterized by removing the removable liner (58*a*) from the card sheet (34) thereby exposing the adhesive (47) disposed on the inside surface (40*a*) of the card sheet (34).

26. A method as set forth in claim 25 further characterized by folding the inside surfaces (38,40*a*) of the frame (32) and card (34) sheets such that the fold strip adhesive (86) bonds first with the card adhesive (47) facilitating accurate folding.

27. A method as set forth in claim 26 further characterized by forming the photographic greeting card assembly, (20) from cellulose fiber and subsequently said outside surface (38) of said frame sheet (32) and at least part of said outside surface (38*a*) of said card sheet (34) overlaminated with a polypropylene laminate.

* * * * *